US009951449B2

(12) United States Patent
Gieskes et al.

(10) Patent No.: US 9,951,449 B2
(45) Date of Patent: Apr. 24, 2018

(54) SEWING MACHINE, SYSTEM AND METHOD

(71) Applicant: UNIVERSAL INSTRUMENTS CORPORATION, Conklin, NY (US)

(72) Inventors: Koenraad Alexander Gieskes, Deposit, NY (US); Hermanna Elisabeth Gieskes, Deposit, NY (US)

(73) Assignee: UNIVERSAL INSTRUMENTS CORPORATION, Conklin, NY (US)

( * ) Notice: Subject to any disclaimer, the term of this patent is extended or adjusted under 35 U.S.C. 154(b) by 0 days.

(21) Appl. No.: 15/500,760

(22) PCT Filed: Jul. 31, 2015

(86) PCT No.: PCT/US2015/043192
§ 371 (c)(1),
(2) Date: Jan. 31, 2017

(87) PCT Pub. No.: WO2016/019283
PCT Pub. Date: Feb. 4, 2016

(65) Prior Publication Data

US 2017/0191200 A1 Jul. 6, 2017

Related U.S. Application Data

(60) Provisional application No. 62/045,447, filed on Sep. 3, 2014, provisional application No. 62/032,204, filed on Aug. 1, 2014.

(51) Int. Cl.
*G06F 7/66* (2006.01)
*D05B 19/12* (2006.01)

(52) U.S. Cl.
CPC ..... *D05B 19/12* (2013.01); *D05D 2205/00* (2013.01); *D05D 2207/00* (2013.01)

(58) Field of Classification Search
CPC ..... D05B 19/02; D05B 19/04; D05B 19/12; D05B 19/14; D05B 19/16; D05C 5/00; D05C 5/02
(Continued)

(56) References Cited

U.S. PATENT DOCUMENTS 4,510,875 A 4/1985 Peck
4,526,116 A 7/1985 Mannel
(Continued)

FOREIGN PATENT DOCUMENTS

CN 107109746 A 8/2017
WO 2016/019283 2/2016

OTHER PUBLICATIONS

Simply Sewing Instructional Basics. Sewing Machine Basics 2, part 1/3—Sewing in straight lines. Dec. 18, 2008. [retrieved on Sep. 28, 2015] <URL:https://www.youtube.com/watch?v=gNw99DzYzKA>.
(Continued)

*Primary Examiner* — Nathan Durham
(74) *Attorney, Agent, or Firm* — Schmeiser, Olsen & Watts, LLP

(57) ABSTRACT

Disclosed herein is a household type sewing machine that includes a transmitter configured to connect to a local device such as a Wi-Fi device, and an image capture device configured to capture a video of a workpiece being sewn by the household type sewing machine. The transmitter is configured to send the video captured by the image capture device to the local device. Further disclosed is a method that includes capturing, by the image capture device, a video of a workpiece being sewn by the household type sewing machine and sending the video captured by the image capture device to a mobile device. A sewing system is further disclosed.

16 Claims, 10 Drawing Sheets

(58) Field of Classification Search
USPC ..... 700/136–138
See application file for complete search history.

(56) References Cited

U.S. PATENT DOCUMENTS

| | | | | |
|---|---|---|---|---|
| 4,658,741 | A | 4/1987 | Jehle et al. | |
| 4,742,789 | A | 5/1988 | Pestel et al. | |
| 4,834,008 | A | 5/1989 | Sadeh et al. | |
| 4,860,675 | A * | 8/1989 | Brower | D05B 11/00 112/119 |
| 4,953,485 | A * | 9/1990 | Brower | D05B 21/00 112/103 |
| 5,048,439 | A | 9/1991 | Tschopp et al. | |
| 5,076,184 | A | 12/1991 | Tschopp et al. | |
| 5,095,835 | A * | 3/1992 | Jernigan | D05B 19/08 112/103 |
| 5,158,026 | A | 10/1992 | Badillo et al. | |
| 5,205,232 | A | 4/1993 | Sadeh et al. | |
| 5,319,565 | A | 6/1994 | Hausammann et al. | |
| 5,375,063 | A | 12/1994 | Peck et al. | |
| 5,474,000 | A | 12/1995 | Mizuno et al. | |
| 5,537,946 | A | 7/1996 | Sadeh et al. | |
| 5,662,055 | A | 9/1997 | Hartwig et al. | |
| 5,782,189 | A | 7/1998 | Hirata et al. | |
| 6,006,686 | A | 12/1999 | Hamajima | |
| 6,119,611 | A | 9/2000 | Tomita | |
| 6,135,038 | A | 10/2000 | Okamoto | |
| 6,216,618 | B1 | 4/2001 | Goldberg et al. | |
| 6,260,495 | B1 | 7/2001 | Stewart et al. | |
| 6,263,815 | B1 * | 7/2001 | Furudate | D05B 7/00 112/470.13 |
| 6,321,671 | B1 | 11/2001 | Tomita | |
| 6,516,240 | B2 | 2/2003 | Ramsey et al. | |
| 6,546,240 | B2 | 2/2003 | Ramsey et al. | |
| 6,708,076 | B2 | 3/2004 | Zhang et al. | |
| 6,813,535 | B2 | 11/2004 | Akira et al. | |
| 6,859,679 | B1 | 2/2005 | Smith et al. | |
| 6,889,111 | B2 | 5/2005 | Tomita | |
| 6,925,351 | B2 | 8/2005 | Larson | |
| 6,944,605 | B2 | 9/2005 | Bailie | |
| 6,950,717 | B1 | 9/2005 | Pierce et al. | |
| 6,994,042 | B2 | 2/2006 | Schweizer | |
| 7,239,868 | B2 | 7/2007 | Furukawa et al. | |
| 7,685,072 | B2 | 3/2010 | Hirata | |
| 7,908,027 | B2 | 3/2011 | Noguchi et al. | |
| 7,949,421 | B2 | 5/2011 | Hayakawa et al. | |
| 8,028,633 | B2 | 10/2011 | Naka et al. | |
| 8,099,185 | B2 | 1/2012 | Dickerson | |
| 8,108,062 | B2 | 1/2012 | Kaymer et al. | |
| 8,116,897 | B2 | 2/2012 | Clayman | |
| 8,161,895 | B2 | 4/2012 | Grufman et al. | |
| 8,186,289 | B2 | 5/2012 | Tokura | |
| 8,245,656 | B2 | 8/2012 | Mori et al. | |
| 8,301,292 | B2 | 10/2012 | Tokura | |
| 8,522,701 | B2 | 9/2013 | Tokura | |
| 8,606,390 | B2 | 12/2013 | Hjalmarsson et al. | |
| 8,633,982 | B2 | 1/2014 | Gylling et al. | |
| 8,755,926 | B2 | 6/2014 | Naka | |
| 8,763,545 | B2 | 7/2014 | Tseng | |
| 8,869,721 | B2 | 10/2014 | Suzuki et al. | |
| 2005/0060058 | A1 * | 3/2005 | Cameron | D05C 5/00 700/138 |
| 2008/0006192 | A1 * | 1/2008 | Zeiger | D05B 19/006 112/102.5 |
| 2008/0115709 | A1 * | 5/2008 | Wentkowski | D05B 19/02 112/470.01 |
| 2010/0106283 | A1 * | 4/2010 | Harvill | D05C 5/04 700/138 |
| 2010/0186646 | A1 * | 7/2010 | Stokes | D05B 69/36 112/470.05 |
| 2010/0199902 | A1 | 8/2010 | Mori et al. | |
| 2011/0146553 | A1 | 6/2011 | Wilhelmsson et al. | |
| 2012/0234222 | A1 | 9/2012 | Naka | |
| 2012/0245727 | A1 * | 9/2012 | Naka | D05B 19/12 700/136 |
| 2013/0049938 | A1 * | 2/2013 | Hooke | G08C 17/02 340/12.5 |
| 2013/0190916 | A1 * | 7/2013 | Schnaufer | D05B 19/12 700/137 |
| 2014/0230706 | A1 | 8/2014 | Suzuki et al. | |
| 2015/0040810 | A1 * | 2/2015 | Kongo | D05B 19/08 112/470.02 |
| 2015/0045939 | A1 * | 2/2015 | Kongo | D05B 19/12 700/143 |
| 2015/0345057 | A1 * | 12/2015 | Kongo | D05B 43/00 112/470.05 |

OTHER PUBLICATIONS

International Search Report and Written Opinion for PCT Application No. PCT/US2015/043192, dated Oct. 26, 2015.
International Preliminary Report on Patentability for PCT Application No. PCT/US2015/043192, dated Aug. 29, 2016.

* cited by examiner

SEWING MACHINE, SYSTEM AND METHOD

CROSS-REFERENCE TO RELATED APPLICATIONS

This application claims priority to PCT Application No. PCT/US2015/043192, having a filing date of Jul. 31, 2015, which claims priority to provisional application Nos. 62/045,447 and 62/032,204, filed on Sep. 3, 2014 and Aug. 1, 2014, respectively, the entire contents of which are hereby incorporated by reference.

FIELD OF TECHNOLOGY

The subject matter disclosed herein relates generally to sewing machines. More particularly, the subject matter relates to a sewing machine.

BACKGROUND

In state of the art sewing machines, an operator feeds fabric with both hands into and under a spring loaded pressure foot where a needle of the sewing machine moves up and down to stitch the fabric together. To achieve sewing a quality garment, the operator must properly attach all components of the fed fabric together in a very precise manner. The precision and delivery of the components of fabric to the sewing area on the sewing machine where the pressure foot is located is highly important in creating and cultivating quality. However, this sewing area is also one of the most difficult areas on the sewing machine for the operator to see while the operator is sewing. Because the components of the fabric move at a constant speed under the pressure foot, the operation of the sewing machine requires continuous attention. Detailed and precise coordination, as well as keen focus with both hands and eyes are necessary to complete this task.

To feed the fabric components, the operator often must lean forward and bend over to closely inspect the sewing area where the needle inserts the thread into the fabric components. Over time, this leads to fatigue, especially for novice and inexperienced operators. This can make the sewing experience unpleasant and can quickly lead to muscle aches and pains in the neck and shoulders.

In these state of the art sewing machines, the quality of the resulting garment or other sewn product depends strongly on the operator's level of expertise, existing skillset and the operator's ability to control the sewing machine while the sewing machine is in motion. To create a quality garment it is generally recommended that an operator take training in a class environment for some period of time. Without any basic training on the skillset required to create a garment, the chance of achieving good quality (e.g. straight seams, smooth fit and even construction) is regrettably small. Moreover, in state of the art sewing machines it is complicated to set up the machine properly with the right stitch type, stitch width and step size/length to achieve the desired result.

Thus, a sewing machine with improved ergonomics and ease of use and a sewing machine, system, and method that provides step-by-step instructions for sewing a garment would be well received in the art.

BRIEF DESCRIPTION

According to one embodiment, a method comprises: providing a household type sewing machine, the household type sewing machine including an image capture device; capturing, by the image capture device, a video of a workpiece being sewn by the household type sewing machine; and sending the video captured by the image capture device to a mobile device.

According to another embodiment, a sewing system comprises: a mobile device including a display; a household type sewing machine including: a transmitter; an image capture device configured to capture a video of a workpiece being sewn by the household type sewing machine; and an application operable on the mobile device, the application facilitating connection of the mobile device with the transmitter of the household type sewing machine, wherein the transmitter is configured to send the video captured by the image capture device to the mobile device; wherein the application is configured to connect the mobile device to the household type sewing machine such that the mobile device is configured to receive and display the video sent by the transmitter of the sewing machine.

According to another embodiment, a household type sewing machine comprises: a bed; a vertical arm rising from the bed; a horizontal arm extending from the vertical arm, the horizontal arm overhanging the bed; a head located at an end of the horizontal arm; a needle bar disposed at the head for enabling transverse oscillation of the needle bar relative to the direction of fabric feed in the household type sewing machine; a transmitter configured to connect to a local device; and an image capture device configured to capture a video of a workpiece being sewn by the household type sewing machine, wherein the transmitter is configured to send the video captured by the image capture device to the local device.

According to another embodiment, a method comprises: providing a sewing pattern; providing, with the sewing pattern, identifying information relating to the sewing pattern; receiving, by a computer system, the identifying information from a mobile device; and providing instructions by the computer system to the mobile device, the instructions relating to how to sew the sewing pattern.

According to another embodiment, a sewing system comprises: a mobile device including a display; an application operable on the mobile device; and a sewing pattern having identifying information, the identifying information providing the application with access to instructions to sew the sewing pattern with a household type sewing machine.

According to another embodiment, a sewing system comprises: a mobile device; an application operable on the mobile device; and a household type sewing machine including a unique identification number, the unique identification number allowing the household type sewing machine to connect to a local Wi-Fi system; wherein the application is configured to provide instructions to the household type sewing machine connected to the local Wi-Fi system, wherein the instructions are receivable by the household type sewing machine and wherein the household type sewing machine is configured to respond to the instructions to perform a function specified in the instructions.

According to another embodiment, a method comprises: providing a mobile device; operating an application on the mobile device; operating a household type sewing machine including a unique identification number; connecting the household type sewing machine to a local Wi-Fi system using the unique identification number; providing, with the application of the mobile device, instructions to the household type sewing machine; receiving, by the household type sewing machine, the instructions; and performing, by the household type sewing machine, a function specified in the instructions.

DETAILED DESCRIPTION

A description of the hereinafter described embodiments of the disclosed apparatus and method are presented herein by way of exemplification and not limitation with reference to the photographs.

Figure 1:
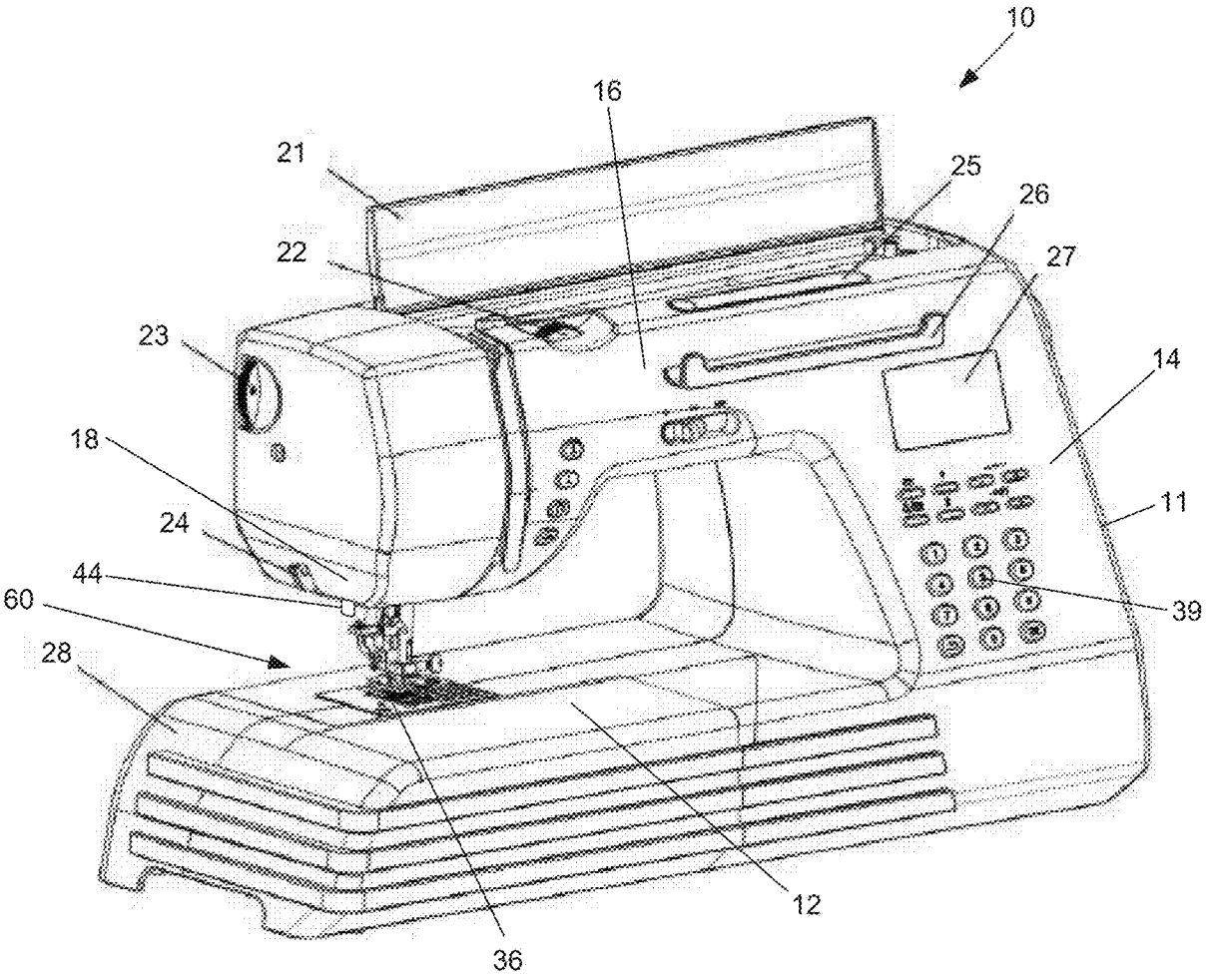
FIG. 1 depicts a front perspective view of a sewing machine in accordance with one embodiment.
Figure 2:
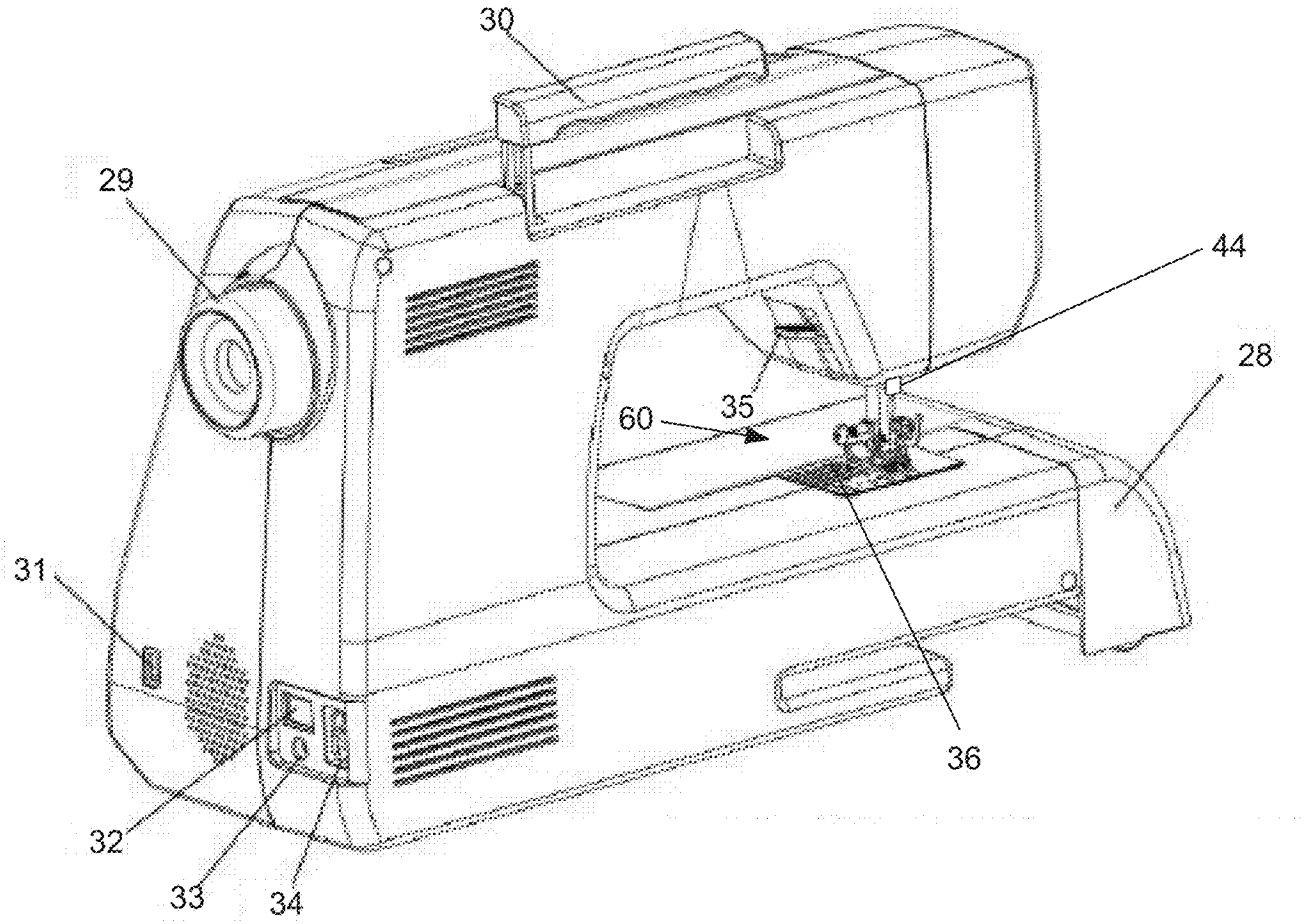
FIG. 2 depicts a back perspective view of the sewing machine of FIG. 1 in accordance with one embodiment.
Figure 3:
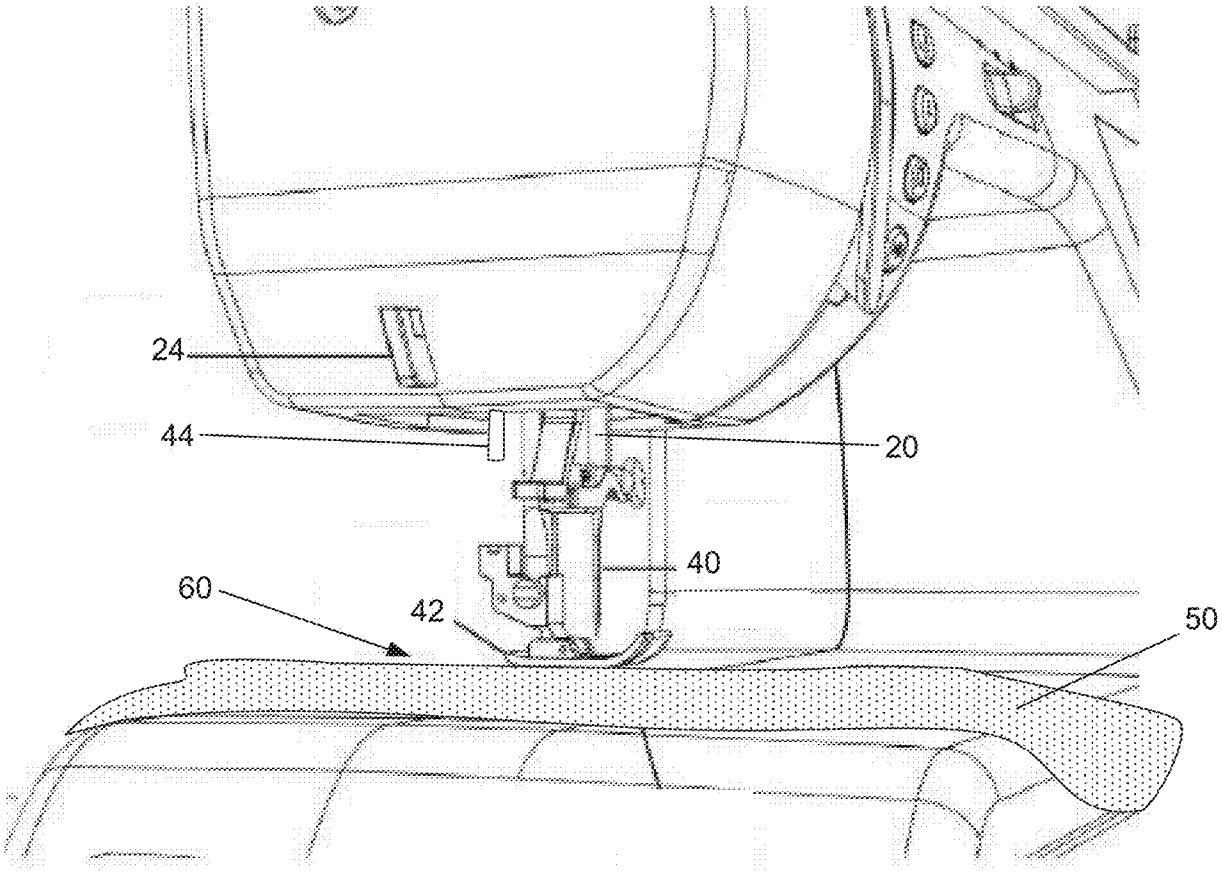
FIG. 3 depicts a perspective view of a sewing area of the sewing machine of FIGS. 1-2 in accordance with one embodiment.

Referring first to FIGS. 1-3, a sewing machine 10 is shown in accordance with one embodiment. The sewing machine 10 includes a main body 11 having a bed 12, a vertical arm 14 rising from the bed 12 and a horizontal arm 16 extending from the vertical arm 14. The horizontal arm 16 is shown overhanging the bed 12. The sewing machine 10 further includes a head 18 located at a distal end of the horizontal arm 16. A needle bar 20 is shown disposed at the head 18. The needle bar 20 is configured to transversely oscillate of the relative to the direction of fabric feed in the sewing machine 10. The sewing machine 10 is shown as a household-type showing machine, rather than an industrial machine.

The sewing machine 10 may include several other components. For example, as shown in FIG. 1, the sewing machine 10 may include a top cap 21, a thread tension dial 22, a presser foot pressure dial 23, a thread cutter 24, a hook 25, a device shelf 26, an LCD display 27, and an accessories box 28. Moreover, as shown in FIG. 2, the sewing machine 10 may include a hand wheel 29, a carrying handle 30, a USB station 31, a main power switch 32, a foot control socket 33, a main power socket 34, and a presser foot lever 35. Other various components may further be included in the sewing machine 10, such as a needle plate 36, a power chord, a foot controller, an automatic thread lever, and fast-change foot lever.

FIG. 3 further shows a sewing area 60 of the sewing machine 10 including a needle 40, a foot 42, along with an image capture device 44 located above the sewing area 60. In one embodiment, the image capture device 44 may be located within the head 18 of the main body 11. In other words, the image capture device 44 may be located at the distal end of the horizontal arm 16. In this embodiment, the image capture device 44 may be housed within the main body 18 such that a lens of the image capture device 44 points out of the head 18 or horizontal arm 16. In the embodiment shown in FIGS. 1-3, the image capture device 44 is pointed at the foot 42 of the sewing machine 10 and at a location behind the foot 42 of the sewing machine on the bed 12. Components of the image capture device 44 may largely or completely be located outside the head 18 or horizontal arm 16 of the main body 11.

The image capture device 44 may be a camera and may be configured to capture images in the direction that the image capture device 44 is pointed. In another embodiment, the image capture device 44 may be configured to continuously take pictures, or may take a video. The image capture device 44 may be integrated into the sewing machine 10. In other embodiments, the image capture device 44 may be mounted on an adapter bracket of a sewing machine (not shown). This adapter bracket may configure embodiments disclosed herein to be operable on existing sewing machines without the need to install an integrated image capture device 44 into the sewing machine.

The image capture device 44 maybe integrated into the head 18 or horizontal arm 16 of the main body 11 in such a manner that the image capture device 44 is configured to move with respect to the main body 11, the head 18 and/or the horizontal arm 16. The lens of the image capture device 44 may be movable such that the image capture device 44 can be pointed in different directions in order to capture images or video of different locations within the sewing area 60. The image capture device 44 may be movable in response to an operator's input on a user interface 39 provided on the sewing machine 10.

While the image capture device 44 is shown in one particular location behind the foot 42 of the sewing machine 10 in the embodiment shown, other locations are contemplated. For example, the image capture device 44 may be located in front of the foot 42 of the sewing machine. It should be understood that "front" means the direction and/or location that the fabric components are fed into the foot 42 while "behind" means the direction and/or location that the sewn fabric components are expelled from the foot 42. In other embodiments, the image capture device 44 may be located proximate the foot 42 such that both the location in front and behind the foot 42 may be captured simultaneously.

Figure 7:
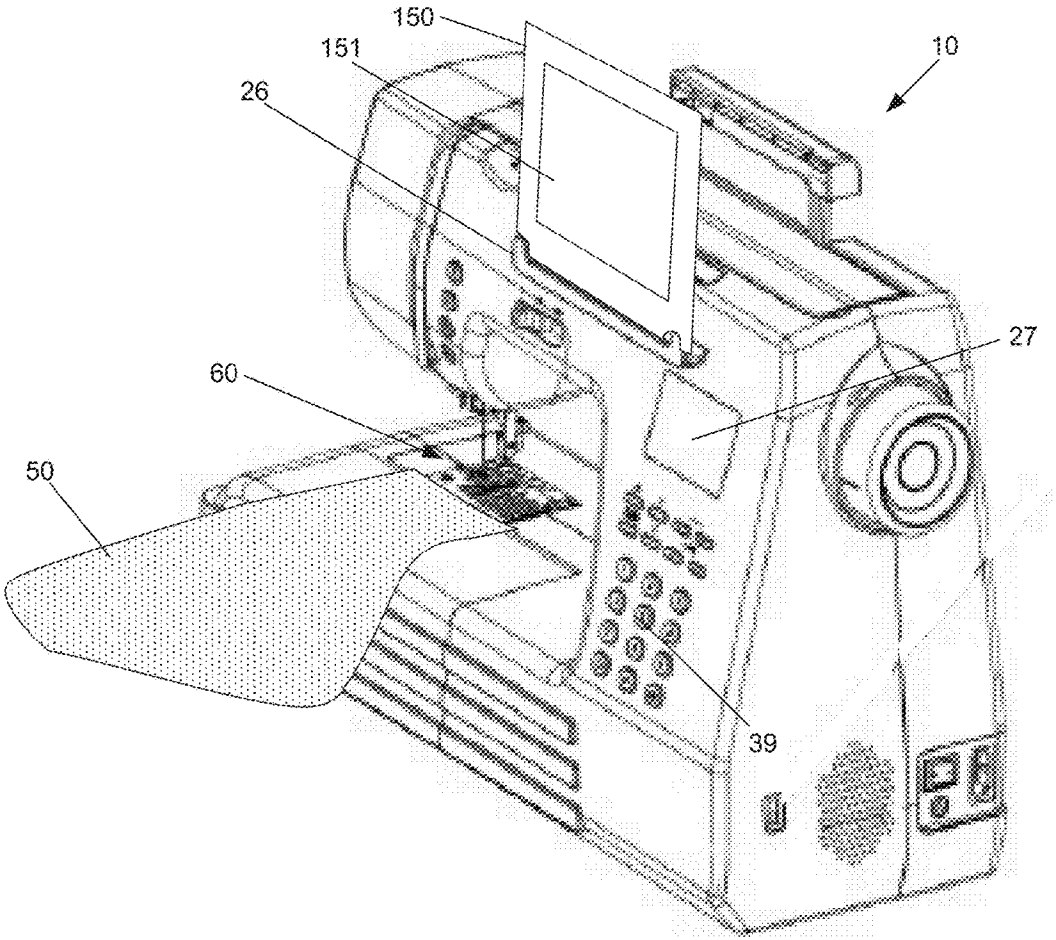
FIG. 7 depicts a mobile device displaying images captured by an image capture device of the sewing machine of FIGS. 1-3 during sewing in accordance with one embodiment.

The image capture device 44 may be configured to capture an image of a workpiece 50 (shown in FIGS. 3 and 7). The workpiece 50 may be any fabric or component being sewn by the sewing machine 10. Thus, the image capture device 44 may capture an overview of the components of the workpiece 50 passing from the front of the needle 40 and/or to the back of the needle 40. The image capture device 44 may capture high quality images and/or video.

Referring now to FIG. 7, the sewing machine 10 is shown with a mobile device 150 resting on a device shelf 26. The mobile device 150 may be a tablet, mobile phones, or the like. The mobile device 150 may be any small computing device, and may be small enough to be handheld and may have a display screen with touch input and/or a miniature keyboard and may weigh less than 2 pounds (0.91 kg). The mobile device 150 may be an off-the-shelf device such as an Iphone®, Ipad®, Kindle®, Surface® or the like which includes a high-resolution display 151. In other embodiments, the mobile device 150 may be replaced by a laptop computer, or a desktop computer, or by another computing device.

The mobile device 150 is shown resting on the device shelf 26. This may allow an operator of the sewing machine 10 to view the display 151 of the mobile device 150 from an ergonomically correct position (i.e. with a straight back and neck). This may prevent the operator from being required to bend over to get a better view of the sewing area 60. The device shelf 26 may be particularly positioned in order to allow an operator to sew with the sewing machine while viewing the mobile device 150 while sitting upright and without bending over.

Figure 8:
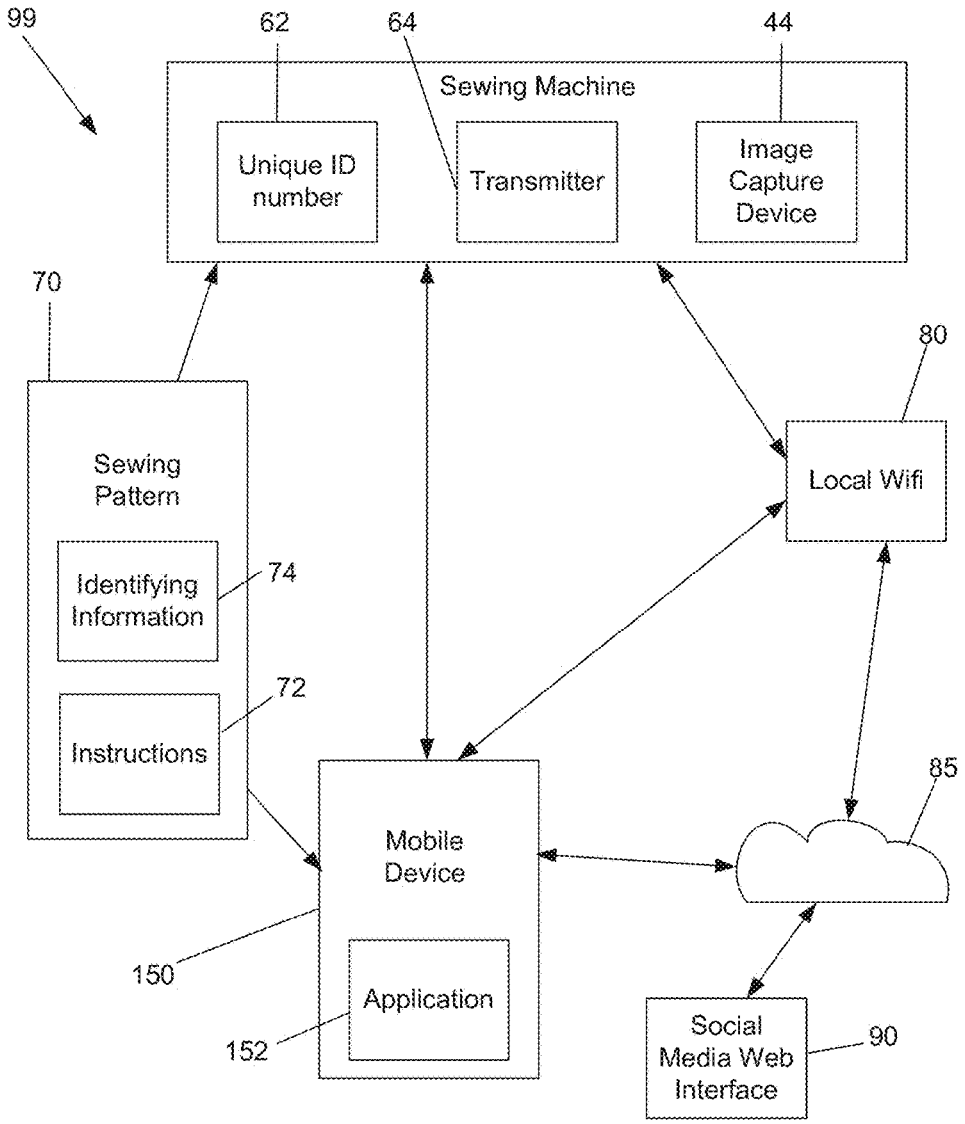
FIG. 8 depicts a schematic view of a system in accordance with one embodiment.

Referring to FIG. 8, the sewing machine 10 may be in operable communication with the mobile device 150 or otherwise connectable to the mobile device 150 such that data, signals and/or information may be transmitted between the sewing machine 10 and the mobile device. In one embodiment, the sewing machine 10 and the mobile device 150 may be connectable via a wired connection. For example, the sewing machine 10 may be connectable by attaching a USB chord between the mobile device 150 and into the USB station 31 of the sewing machine 10. In another, the sewing machine 10 and the mobile device 150 may be connectable via a wireless connection, for example over a local Wi-Fi network 80. It should be understood that the sewing machine 10 may include a transmitter that is capable of connecting to a local device as part of the local Wi-Fi network 80, such as a router, switch, or the like. Furthermore, the sewing machine 10 may be connectable to other local devices directly, such as the mobile device 150 or another local device such as a laptop or desktop computer. Furthermore, the sewing machine may 10 further be connectable via a wired or wireless connection to the local device and or the local Wi-Fi network 80.

In the schematic shown in FIG. 8, a sewing system 99 may include the sewing machine 10, a sewing pattern 70, the mobile device 150, a local Wi-Fi network 80, the internet 85, and/or a social media web interface 90. The sewing machine 10 may include a unique identification number 62 and a transmitter 64, a receiver and/or a transceiver. The sewing machine 10 may further include a processor for performing any computer processing computations required to execute the method(s) and functionality described herein. The processor will be described in greater detail hereinbelow. The transmitter 64, receiver and/or transceiver may transmit wirelessly or via a wire. The sewing machine 10 may be configured for either or both or receiving and sending signals, data or information. The unique identification number 62 may be an IP address or some other network identification number that may be configured to allow the sewing machine 10 to connect to a local Wi-Fi network 80 or local area network (LAN). The sewing machine 10 may thereby be configured to wirelessly, or with a network wire, send and/or receive data, signals or information to and from the local Wi-Fi network 80.

The sewing machine 10 may be configured to transmit the image and/or video captured by the image capture device 44 to the mobile device 150 such that the image and/or video is displayable on the screen 151 of the mobile device 150. The mobile device 150 may be configured to display an enlarged, high resolution, real-time image of the location being sewn by the operator. The transmitted image may be sent by the transmitter 64 directly to the mobile device 150 or through the local Wi-Fi network 80 before arriving at the mobile device 150.

The mobile device 150 is shown having an application 152 operable on the mobile device 150. The application 152 may be downloaded from an application store such as Itunes® or the like. Free access or other access to the application may be provided to an operator or owner of a mobile device 150 by having the operator input a code (unique or otherwise) provided with the purchase of the sewing machine 10. In other embodiments, the application 152 may be free for any user to download onto a mobile device such as the mobile device 150. Other means of providing the application 152 to the mobile device 150 are contemplated such as a hosted web server accessible by browsing a website. The website may be hosted by the maker or manufacturer of the sewing machine 10.

The application 152 may be configured to facilitate connection of the mobile device 150 to the sewing machine 10. The application 152, once loaded, may enable the mobile device 150 to locate the sewing machine 10 on the local Wi-Fi network 80 or in the cloud 85. The application 152 may further facilitate the receiving of the images and/or video from the sewing machine 10 taken by the image capture device 44. The application 152 may be configured to display the images and/or video from the sewing machine 10 taken by the image capture device 44 on the display 151. Thus, the application 152 may be configured to connect the mobile device 150 to the sewing machine 10 such that the mobile device 150 is configured to receive and display video sent by the transmitter 64 of the sewing machine 10 on the display 151. This may be displayed in real-time as the image and/or video is being captured by the image capture device 44.

In another embodiment, the application 152 may provide step-by-step instructions to perform a sewing pattern in order to help inexperienced operators, or even experienced operators, achieve better results when sewing with the sewing machine 10. In one embodiment, these step-by-step instructions may be included with the data within the application 152 when the application 152 is loaded or downloaded or installed on the mobile device 10.

In another embodiment, access to step-by-step instructions 74 by the application 152 may be provided with the purchase or acquisition of the sewing pattern 70. As shown in FIG. 7, the sewing pattern 70 may include identifying information 72. The identifying information 72 may come in the form of a UPC number, a bar code, an RFID code or another type of access code, or the like. The identifying information 72 may be found on the paper sewing pattern found in the sewing pattern 70. The step-by-step instructions 74 may be provided by the manufacturer of the sewing pattern 70 in one embodiment. The step-by-step instructions 74 may allow for the application 152 to download a video guide. The step-by-step instructions 74 may include instructions for cutting the pattern, preparation prior to sewing and may even provide a guide for the taking of the proper measurements of the person for whom the garment is being made. It should be understood that the sewing patterns 70, and accompanying instructions 74 may be sold individually, or in bulk.

In another embodiment, rather than purchasing the sewing pattern 70 in a physical form, the sewing pattern 70 may be a digital sewing pattern purchasable by accessing a digital store found in the application 152 or other website. This embodiment may preclude the need to provide identifying information 72 with the sewing pattern 70. This may be because the digital sewing pattern 70 may automatically be provided with these step-by-step instructions 74.

In operation, a person owning the sewing machine 10 may purchase the sewing pattern 70 and be provided with the identifying information 72. The person may then execute the application 152 on the mobile device 150 and enter the identifying information 72 into the application 152. This may then provide the application 152 with access to the step-by-step instructions 74. While the application 152 is running, the mobile device 150 may also be connected to the sewing machine 10 as described hereinabove. Once this connection is established, the mobile device 150 may begin receiving image or video from the image capture device 44 of the sewing machine 10 and displaying images continuously or displaying video on the display 151 of the device 150. The step-by-step instructions 74 for sewing a particular pattern may also be displayed on the display 151 of the device 150 simultaneous with the display of the video or images from the image capture device 44. Alternatively, the step-by-step instructions 74 may be provided before or after the image or video is being displayed during the sewing. In one embodiment, the step-by-step instructions 74 may be overlaid on top of the video being shown on the display 151. In another embodiment, the application 152 may display a split screen showing the instructions 74 in one location of the screen and the video or image from the image capture device 44 on another location. Thus, an operator may sew the pattern with the workpiece 50 while watching the screen 151 of the mobile device 150 instead of bending over to see the sewing area 60 directly. The instructions 74 may be provided on the display 151 while the operator is sewing the pattern as well.

Moreover, the application 152, using information provided or downloaded with the instructions 74 provided with the sewing pattern 70, may be used to manage the sewing machine 10. In this embodiment, the application 152 may be configured to receive an input from the operator that may send a signal, instruction, or the like to the sewing machine 10. The instructions may be receivable by the processor (not shown) of sewing machine 10. The sewing machine may be configured to, for example, respond to the instructions to perform a function specified in the instructions. For example, the instructions provided by the user may be to adjust the sewing machine 10 to the correct stitches or actions required by the operator. Thus, the application 152 may include an interface configured to receive inputs by the operator to provide these instructions to the sewing machine 10.

Furthermore, the instructions, once loaded by the application 152, may cause the application 152 to automatically send instructions to the sewing machine in order to change settings on the sewing machine 10 automatically. This setting adjustment or change may put the sewing machine 10 into the proper mode to stitch the particular pattern 70 intended to be sewn. This may preclude the need for setup and automate the process to prevent user error with setting up the sewing machine with the proper stitch type, etc.

Still further, the application 152 may be configured to facilitate uploading the video provided by the image capture device 44 to the social media web interface 90. The social media web interface 90 may be Facebook®, Instagram®, Twitter® or the like. Thus, the mobile device 150 may be connectable to the internet 85 when the application 152 is running. The application 152 may continuously save or store the images and/or video being sent by the image capture device and displayed on the display 151. These images and/or video may then be uploaded by pressing a button or utilizing an interface provided in the application 152.

Referring still to FIG. 8, another system is contemplated whereby the mobile device 150 is not included. In this embodiment, the features and functionality described hereinabove performed by the mobile device 150 may be performed by the sewing machine 10 instead. Thus, the sewing machine 10 may utilize the internal processor and the display 27 for showing the image and/or video captured by the image capture device 44. In other embodiments, a larger display than the display 27 shown are contemplated. The sewing machine 10 may include the user interface 39 shown below the display 27 for accessing the step-by-step instructions from the sewing pattern 70. Furthermore, the application 152 may be loaded into a memory device found within the sewing machine 10. Similar to the embodiment described hereinabove, the application 152 running on the sewing machine 10 may be configured to display the video captured by the image capture device 44 on the display 27. The sewing machine 10 may thus be connectable to the social media web interface 90 as well to allow for the uploading of captured video.

In another embodiment, the mobile device 150 may be used to replace the image capture device 44 in the sewing machine 10. In this embodiment (not shown) a sewing machine may include an adjustable bracket or holder for holding the mobile device 150 in a location that it can capture the proper image of the sewing area 60. The mobile device 150 may simultaneously display this image and/or video on the display of the mobile device 151 in the same manner described hereinabove. In this embodiment, mirrors may be utilized in order to capture an image at the right angle and location and still achieve displaying the image on the mobile device 150 in a form that allows for good posture in the operator. In other words, if the mobile device 150 is both the display device and the image capture device of the system, one or more mirrors may be utilized to ensure that the image capture is proper while retaining the display 151 in an easily viewable position.

Figure 4:
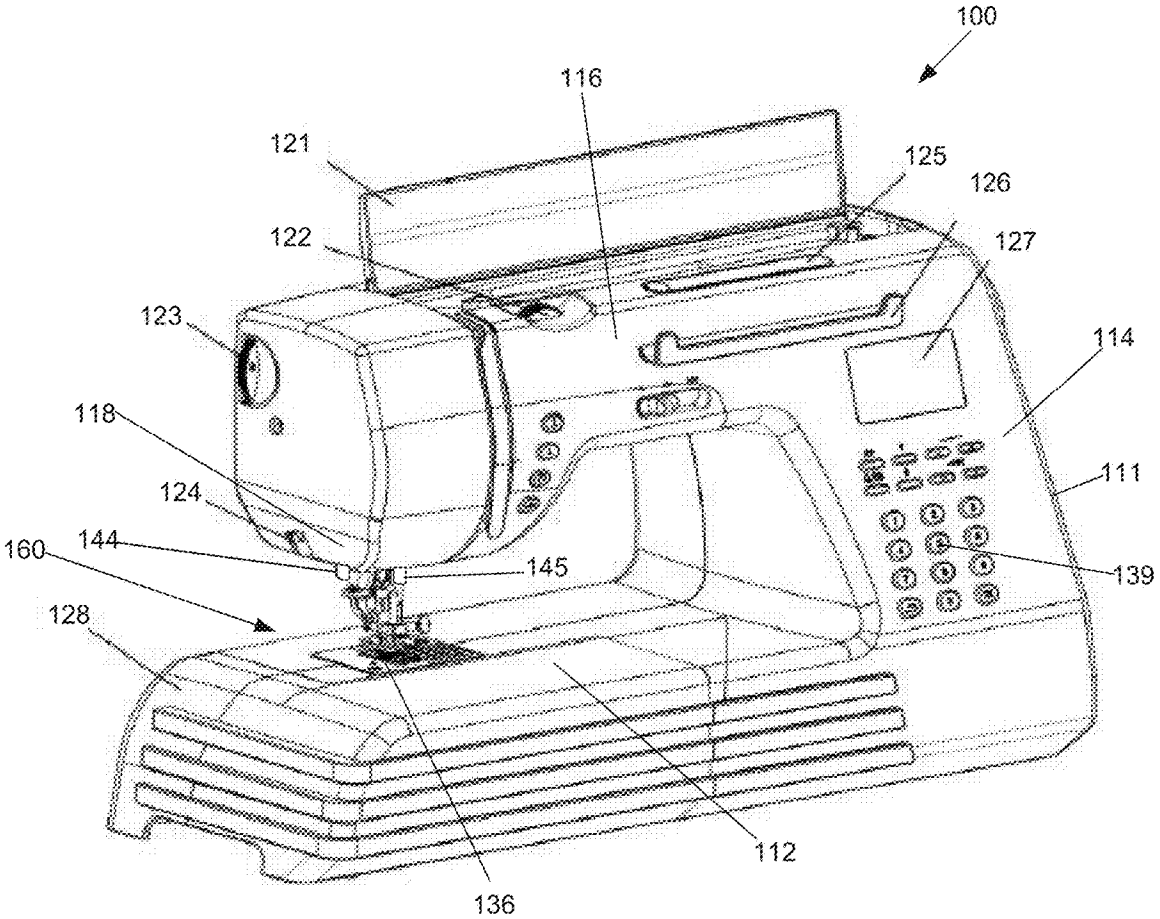
FIG. 4 depicts a front perspective view of a sewing machine in accordance with another embodiment.
Figure 5:
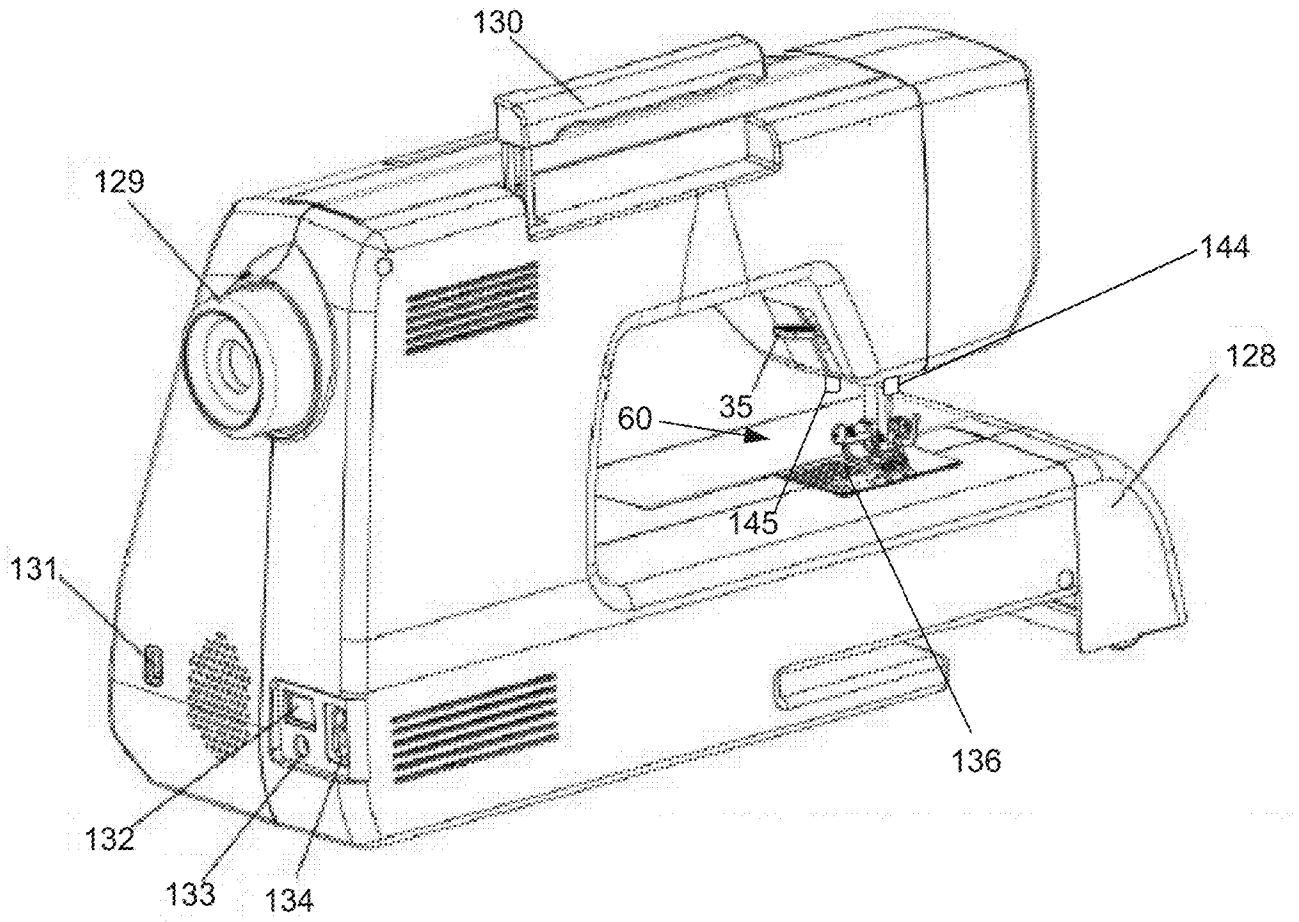
FIG. 5 depicts a back perspective view of the sewing machine of FIG. 4 in accordance with one embodiment.
Figure 6:
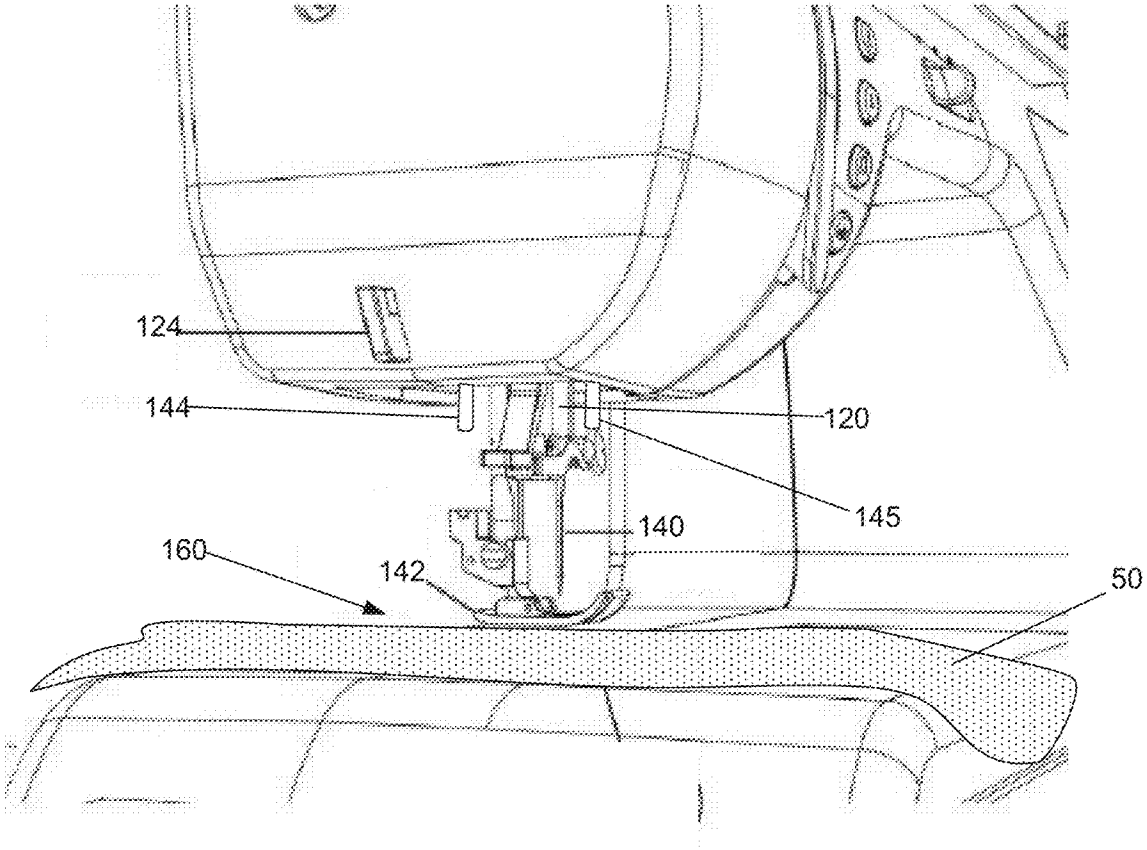
FIG. 6 depicts a perspective view of a sewing area of the sewing machine of FIGS. 4-5 in accordance with one embodiment.

Still further, referring to FIGS. 4-6, another embodiment of a sewing machine 100 is shown. The sewing machine 100 may be similar to the sewing machine 10 described hereinabove. Thus, the sewing machine 100 includes a main body 111 having a bed 112, a vertical arm 114 rising from the bed 112 and a horizontal arm 116 extending from the vertical arm 114. The horizontal arm 116 is shown overhanging the bed 112. The sewing machine 100 further includes a head 118 located at a distal end of the horizontal arm 116. A needle bar 120 is shown disposed at the head 118. The needle bar 120 is configured to transversely oscillate of the relative to the direction of fabric feed in the sewing machine 100. The sewing machine 100 is shown as a household-type showing machine, rather than an industrial machine.

The sewing machine 100 may include several other components. For example, as shown in FIG. 4, the sewing machine 100 may include a top cap 121, a thread tension dial 122, a presser foot pressure dial 123, a thread cutter 124, a hook 125, a device shelf 126, an LCD display 127, and an accessories box 128. Moreover, as shown in FIG. 5, the sewing machine 100 may include a hand wheel 129, a carrying handle 130, a USB station 131, a main power switch 132, a foot control socket 133, a main power socket 134, and a presser foot lever 135. Other various components may further be included in the sewing machine 100, such as a needle plate 136, a power chord, a foot controller, an automatic thread lever, and fast-change foot lever.

FIG. 6 further shows a sewing area 160 of the sewing machine 100 including a needle 140, and a foot 142. Rather than including one image capture device, as described hereinabove with respect to the sewing machine 10, the sewing machine 100 may include a first image capture device 144 and a second image capture device 145. The first image capture device 144 may be located above a location that is behind the foot 142 and the needle 140 while the second image capture device 145 may be located above a location that is in front of the foot 142 and the needle 140. In this embodiment, the application 152 described hereinabove may have options for displaying the images captured by both of the image capture devices 144, 145. For example, the application 152 may be configured to display, via a split screen, the images and/or video captured by the image capture devices 144, 145 simultaneously during sewing. Alternatively, an operator may select one image capture device 144 to display at a time. The application 152 may allow a user to toggle between which displays to show. In other embodiments, more than two image capture devices are contemplated. Still further, another embodiment is contemplated whereby two or more image capture devices are directed at different locations surrounding the needle 140. The application 152 may include functionality for taking the images from each of the plurality of image capture devices, and combining these into a single cohesive image for viewing.

Various methods are also contemplated. In one embodiment, a method may include providing a household type sewing machine, such as one of the sewing machines 10, 100. The method may include capturing, by an image capture device of the household type sewing machine, such as the image capture devices 44, 144, 145, a video of a workpiece, such as the workpiece 50, being sewn by the household type sewing machine. The method may further include sending the video captured by the image capture device to a mobile device, such as the mobile device 150. The method may still further include displaying the video captured by the image capture device on a display, such as the display 151, of the mobile device. The method may still further include capturing a foot, such as the foot 42, 142, and a location behind the foot with the image capture device.

The method may further include providing a unique identification number, such as the unique identification number 62, to the household type sewing machine to connect to a local Wi-Fi system, such as the local Wi-Fi network 80. The method may further include connecting the sewing machine to the local Wi-Fi system. The method may further include providing instructions, such as the instructions 74, on the display of the mobile device for a sewer or operator to perform sewing. The method may further include providing identifying information with a purchased sewing pattern, such as the sewing pattern 70, and providing the mobile device with access to the instructions with the identifying information.

The method also includes providing an application, such as the application 152, to the mobile device and establishing a connection between the mobile device and the sewing machine, which may be facilitated by the application. The method may include uploading, by the mobile device, the received video onto a social media web interface, such as the social media web interface 90. Still further, the method may include providing a second image capture device, such as the second image capture device 145, on the sewing machine, the second image capture device capturing an image of the workpiece at a location in front of the foot.

Moreover, another method may include providing a sewing pattern, such as the sewing pattern 70, providing with the sewing pattern identifying information, such as the identifying information 72, relating to the sewing pattern. The method may include receiving, by a computer system, such as a host system hosted by the maker of the application or the sewing pattern, identifying information from a mobile device, such as the mobile device 150. The method may include providing instructions, such as the instructions 74 by the computer system to the mobile device, the instructions relating to how to sew the sewing pattern. The instructions may be a step-by-step guide to sew the sewing pattern. The method may further include providing an application, such as the application 152, to a mobile device, such as the mobile device 150, the application facilitating transmitting the identifying information from the mobile device to the computer system. The method may include facilitating, by the application, displaying the instructions on a display, such as the display 151 of the mobile device.

The method may include receiving, by the mobile device, a video captured by an image capture device, such as the image capture device 44, 144, 145, from a sewing machine, such as the sewing machine 10, 100. The method may include displaying, by the mobile device, the video captured by the image capture device, on the display of the mobile device. The instructions may be displayed on the display of the mobile device simultaneous with the video captured by the image capture device. The method may also include facilitating uploading, by the application, the video onto a social media web interface such as the social media web interface 90.

Still another method may include providing a mobile device, such as the mobile device 150. The method may include operating an application, such as the application 152, on the mobile device. The method may include operating a household type sewing machine, such as the sewing machine 10, 100, including a unique identification number, such as the unique identification number 62. The method may include connecting the household type sewing machine to a local Wi-Fi system, such as the local Wi-Fi network 80, using the unique identification number. The method may include providing, with the application of the mobile device, instructions, such as the instructions 74, to the household type sewing machine. The method may include receiving, by the household type sewing machine, the instructions and performing, by the household type sewing machine, a function specified in the instructions. The method may further include automatically providing the instructions to the sewing machine when a user chooses the particular set of instructions in the application. The method may further include automatically providing a plurality of instructions to the sewing machine with a single command from the application, where the instructions relate to the sewing pattern.

Figure 9B:
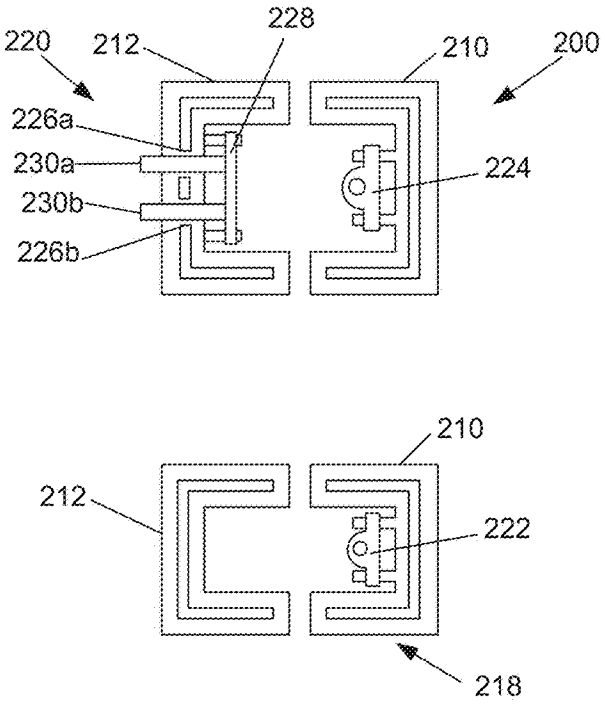
FIG. 9*b* depicts a cross sectional view of the sewing machine of FIG. 9*a*, taken at arrows 9*b*-9*b*.
Figure 9A:
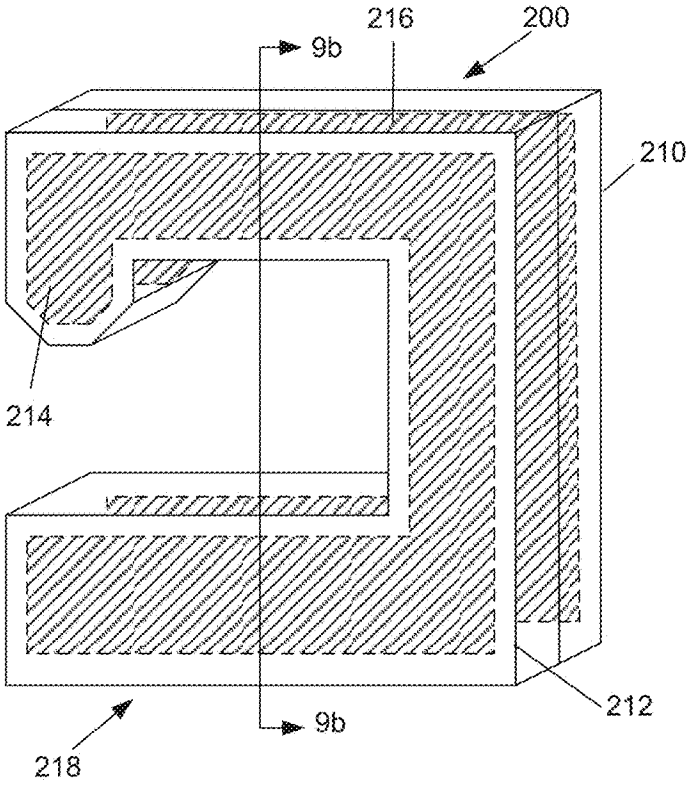
FIG. 9*a* depicts a perspective view of a sewing machine in accordance with one embodiment.

Referring now to FIG. 9*a*, another embodiment of a sewing machine 200 is shown. The sewing machine 200 includes a first metal C-shaped part 214 and a second metal C-shaped part 216. The first and second metal C-shaped parts 214, 216 may be stamped sheet metal and provide a portion of the frame. The first and second metal C-shaped parts 214, 216 may be subsequently placed and held in position inside the injection mold of the plastic injection machine that may produce a first and second plastic frame 210, 212 around the first and second metal C-shaped parts 214, 216, respectively. In this way, an injection machine may create two halves that form the shell type enclosure of the sewing machine. The sheet metal C-shaped parts 214, 216 may be shaped to provide a smooth flowing outside for the sewing machine and can be perforated with smaller and larger holes for functional requirements or to enable the plastic to flow while still providing the stiffness that may be needed for the sewing of heavy fabrics. The first and second metal C-shaped parts 214, 216 may further add weight to be able to run the sewing machine comfortably at higher speeds.

Referring now to FIG. 9*b*, a cross sectional view taken at arrows 9*b*-9*b* from FIG. 9*a* is shown. FIG. 9*b* shows both a cross sectional view of a top horizontal arm 220 and a bed 218. As shown by the cross section of the top horizontal arm 220, the over-molding process of the metal C-shaped parts 214, 216 allows for the same integration of functions to mount functional parts as a prior art sewing machine. This can be seen by the top horizontal arm 220 having a first push button 230*a* and a second push button 230*b* attached to a board or electric assembly 228. The metal C-shaped parts 214, 216 may be fashioned with openings 226*a*, 226*b* for receiving the push buttons 230*a*, 230*b* and other integration of functions and functional parts. Similarly, the cross sections show that an upper drive shaft 224 and a lower drive shaft 222 may be attached to each of the top horizontal arm 220, and bottom bed 218, respectively. These shafts 222, 224 may be integrated in the plastic overmolded parts 210, 212.

In another embodiment (not shown) the stamped sheet metal C-shaped parts may be only partially overmolded, exposing the sheet metal on the inside of the sewing machine. Alternatively, the partial overmolded sheet metal may be exposed on the outside of the sewing machine. Another alternative embodiment may include mounting stamped sheet metal C-shaped plates to the inside of a molded plastic frame. In yet another embodiment, overmolding may not be necessary at all. The concept of having metal material mounted, fashioned or otherwise located within an outershell of plastic is contemplated in any form or manner. This metal may provide stiffness, weight, stability and simplify assembly.

Furthermore, other types of metallic internal components are contemplated which may be surrounded by a plastic or a nonmetallic skin or shell. For example, a single C-shaped metal plate is contemplated, rather than two stamped sheet metal parts. Moreover, other forms of metal are contemplated beyond sheet metal, such as metal bars, tubes, rods, or the like, which may be placed within a plastic molding to increase stiffness and weight to the system.

Additionally, non-C-shapes are also contemplated. For example, only the lower half (or only the upper half) of the C shape of the sewing machine may include the one or more metallic inner layer(s) or components surrounded by the plastic skin. This may provide stability of the machine at the base where stability may be the most necessary. Furthermore, the metal layer may be fully exposed form the underside of the sewing machine (thereby the plastic shell may not actually surround the metal underneath the sewing machine). Steel, stainless steel, copper, aluminum, bronze, and brass or other metals are contemplated instead of the sheet metal described hereinabove. It is contemplated that in embodiments, the metal structure may be durable, low cost, and may vary in weight depending on the application.

Figure 10:
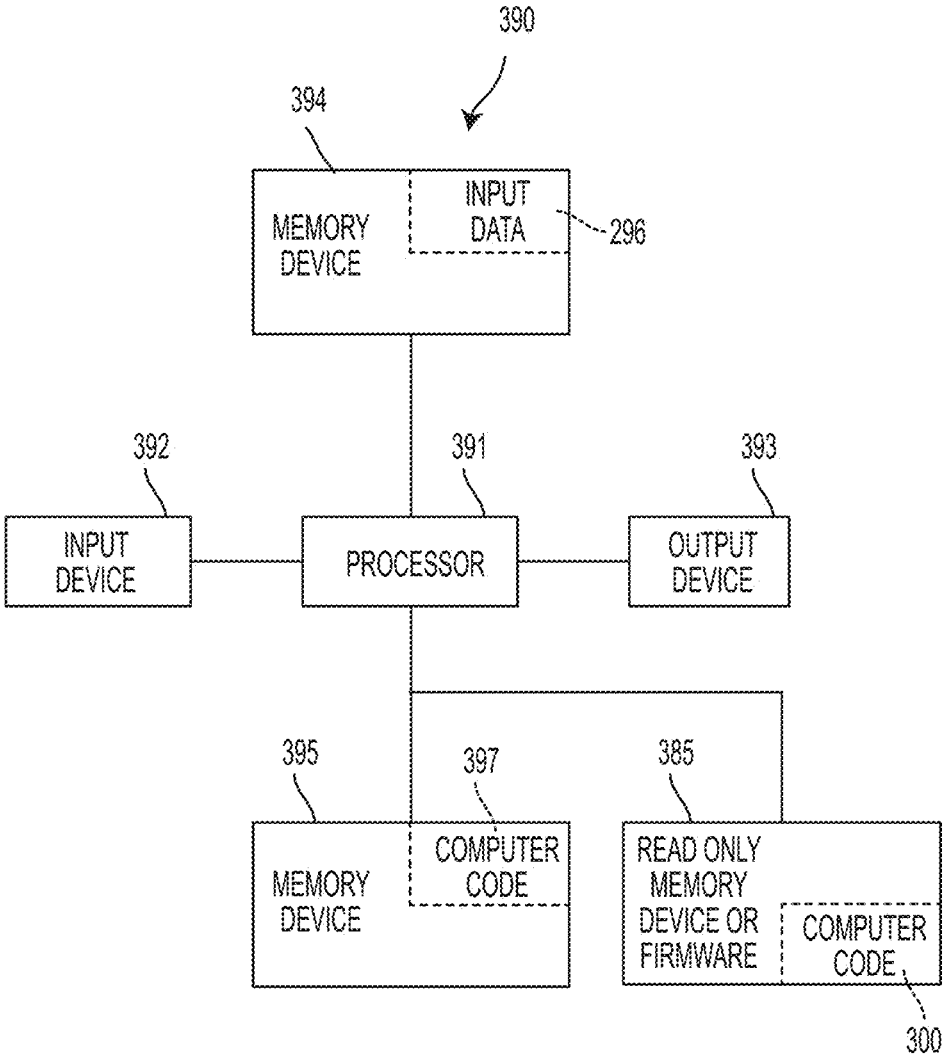
FIG. 10 depicts a schematic of a computer system in accordance with one embodiment.

FIG. 10 illustrates a computer system 390. The computer system 390 may represent any computer system described hereinabove. For example, the computer system 390 may represent the processor or computer system housed within the sewing machine 10, 100. Alternatively, the computer system 390 shown in FIG. 10 may represent the computer system within the mobile device 150. The computer system 390 may still further represent a computer system that hosts the website that distributes the application 152 or the instructions 74. The computer system 390 may thereby be one, all or any of the computer systems used by the system of FIG. 8, or in the sewing machines 10, 100, mobile device 150 or the like, and may be utilized to perform the methods described herein.

Aspects of the present invention may take the form of an entirely hardware embodiment, an entirely software embodiment (including firmware, resident software, microcode, etc.) or an embodiment combining software and hardware aspects that may all generally be referred to herein as a "circuit," "module," or "system."

The present invention may be a system, a method, and/or a computer program product. The computer program product may include a computer readable storage medium (or media) having computer readable program instructions thereon for causing a processor to carry out aspects of the present invention described hereinabove.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing apparatus receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to the block diagram of FIG. 8, device (and systems), and computer program products according to embodiments of the invention. It will be understood that each block of the block diagrams, and combinations of blocks can be implemented by and/or created with computer readable program instructions.

These computer readable program instructions may be provided to a processor of a general purpose computer, special purpose computer, or other programmable data processing device to produce a machine, such that the instructions, which execute via the processor of the computer or other programmable data processing device, create means for implementing the functions/acts specified hereinabove. These computer readable program instructions may also be stored in a computer readable storage medium that can direct a computer, a programmable data processing device, and/or other devices to function in a particular manner, such that the computer readable storage medium having instructions stored therein comprises an article of manufacture including instructions which implement aspects of the function/act specified hereinabove.

The computer readable program instructions may also be loaded onto a computer, other programmable data processing device, or other device to cause a series of operational steps to be performed on the computer, other programmable device or other device to produce a computer implemented process, such that the instructions which execute on the computer, other programmable device, or other device implement the functions/acts specified hereinabove.

The block diagram in the Figure may illustrate the architecture, functionality, and operation of possible implementations of systems, methods, and computer program products according to various embodiments of the present invention. In this regard, each block in the block diagram may represent a module, segment, or portion of instructions, which comprises one or more executable instructions for implementing the specified logical function(s) described hereinabove. It will also be noted that each functionalities described hereinabove can be implemented by special purpose hardware-based systems that perform the specified functions or acts or carry out combinations of special purpose hardware and computer instructions.

The computer system 390 illustrated in FIG. 10 may include a processor 391, an input device 392 coupled to the processor 391, an output device 393 coupled to the processor 391, and memory devices 394 and 395 each coupled to the processor 391. The input device 392 may be, inter alia, a keyboard, a mouse, a camera, a touchscreen, etc. The output device 393 may be, inter alia, a printer, a plotter, a computer screen, a magnetic tape, a removable hard disk, a floppy disk, etc. The memory devices 394 and 395 may be, inter alia, a hard disk, a floppy disk, a magnetic tape, an optical storage such as a compact disc (CD) or a digital video disc (DVD), a dynamic random access memory (DRAM), a read-only memory (ROM), etc. The memory device 395 includes a computer code 397. The computer code 397 includes algorithms (e.g., the functionality described hereinabove) for enabling a process for performing the methods described hereinabove. The processor 391 executes the computer code 397. The memory device 394 includes input data 396. The input data 396 includes input required by the computer code 397. The output device 393 displays output from the computer code 397. Either or both memory devices 394 and 395 (or one or more additional memory devices Such as read only memory device 396) may include the algorithms described hereinabove and may be used as a computer usable medium (or a computer readable medium or a program storage device) having a computer readable program code embodied therein and/or having other data stored therein, wherein the computer readable program code includes the computer code 397. Generally, a computer program product (or, alternatively, an article of manufacture) of the computer system 390 may include the computer usable medium (or the program storage device).

In some embodiments, rather than being stored and accessed from a hard drive, optical disc or other writeable, rewriteable, or removable hardware memory device 395, stored computer program code 384 (e.g., including the algorithms for performing the functionality described hereinabove) may be stored on a static, nonremovable, read-only storage medium such as a Read-Only Memory (ROM) device 385, or may be accessed by processor 391 directly from such a static, nonremovable, read-only medium 385. Similarly, in some embodiments, stored computer program code 397 may be stored as computer-readable firmware 385, or may be accessed by processor 391 directly from such firmware 385, rather than from a more dynamic or removable hardware data-storage device 395, such as a hard drive or optical disc.

Still yet, any of the components of the present invention could be created, integrated, hosted, maintained, deployed, managed, serviced, etc. by a service supplier who performs the described methods and functionality. Thus, the present invention discloses a process for deploying, creating, integrating, hosting, maintaining, and/or integrating computing infrastructure, including integrating computer-readable code into the computer system 390, wherein the code in combination with the computer system 390 is capable of performing the methods described hereinabove. In another embodiment, the invention provides a business method that performs the process steps of the invention on a subscription, advertising, and/or fee basis. That is, a service supplier, such as a Solution Integrator, could offer to enable the processes described hereinabove. In this case, the service supplier can create, maintain, support, etc. a computer infrastructure that performs the process steps of the invention for one or more customers. In return, the service supplier can receive payment from the customer(s) under a subscription and/or fee agreement and/or the service supplier can receive payment from the sale of advertising content to one or more third parties.

While FIG. 10 shows the computer system 390 as a particular configuration of hardware and software, any configuration of hardware and software, as would be known to a person of ordinary skill in the art, may be utilized for the purposes stated supra in conjunction with the particular computer system 390 of FIG. 10. For example, the memory devices 394 and 395 may be portions of a single memory device rather than separate memory devices.

Elements of the embodiments have been introduced with either the articles "a" or "an." The articles are intended to mean that there are one or more of the elements. The terms "including" and "having" and their derivatives are intended to be inclusive such that there may be additional elements other than the elements listed. The conjunction "or" when used with a list of at least two terms is intended to mean any term or combination of terms. The terms "first" and "second" are used to distinguish elements and are not used to denote a particular order.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A method comprising:

providing a household type sewing machine, the household type sewing machine including an image capture device;

providing a mobile device;

providing, by a host server, an application to the mobile device, facilitating, by the application, a connection between the mobile device and the sewing machine, providing, by the application, instructions relating to a sewing pattern on a display of the mobile device;

capturing, by the image capture device, a video of a workpiece being sewn by the household type sewing machine; and sending the video captured by the image capture device to a mobile device wirelessly over at least one of an internet and a wireless local area network.

2. The method of claim 1, further comprising displaying the video captured by the image capture device on a display of the mobile device.

3. The method of claim 1, wherein the capturing the video of the workpiece comprises capturing of the video of a foot of the household type sewing machine and a location behind the foot.

4. The method of claim 3, further comprising providing a second image capture device on the household type sewing machine, the second image capture device capturing an image of the workpiece at a location in front of the foot.

5. The method of claim 1, further comprising providing identifying information with a purchasable physical sewing pattern, wherein receiving the identifying information by the application provides the mobile device with access, through the host server or a second host server, to the instructions related to the sewing pattern.

6. The method of claim 5, further comprising:

providing, with the application of the mobile device, machine instructions to the household type sewing machine;

receiving, by the household type sewing machine, the machine instructions; and performing, by the household type sewing machine, a function specified in the machine instructions.

7. The method of claim 1, further comprising uploading, using the application on the mobile device, the video onto a social media web interface.

8. A sewing system comprising:

a mobile device including a display;

a household type sewing machine including:

a transmitter;

an image capture device configured to capture a video of a workpiece being sewn by the household type sewing machine; and an application operable on the mobile device, the application facilitating connection of the mobile device with the transmitter of the household type sewing machine wirelessly over at least one of an internet and a wireless local area network, wherein the transmitter is configured to send the video captured by the image capture device to the mobile device, wherein the application is configured to connect the mobile device to the household type sewing machine such that the mobile device is configured to receive and display the video sent by the transmitter of the sewing machine, wherein the application is configured to provide instructions relating to a sewing pattern to a display of the mobile device.

9. The sewing system of claim 8, further comprising a purchasable physical sewing pattern including identifying information, wherein the application is configured to receive the identifying information and wherein the identifying information received by the application provides the mobile device with access to the instructions relating to the sewing pattern.

10. The sewing system of claim 8, further comprising:

at least one host server, the at least one host server including:

the instructions related to a sewing pattern configured to be provided for download to the mobile device; and the application configured to be provided for download to the mobile device.

11. The sewing system of claim 8, wherein the application is configured to facilitate uploading, by the mobile device, the video onto a social media web interface.

12. The sewing system of claim 8, wherein the application is configured to provide machine instructions to the household type sewing machine, wherein the household type sewing machine is configured to receive the machine instructions and perform a function specified in the machine instructions.

13. A household type sewing machine system comprising:

a household type sewing machine including:

a bed;

a vertical arm rising from the bed;

a horizontal arm extending from the vertical arm, the horizontal arm overhanging the bed;

a head located at an end of the horizontal arm;

a needle bar disposed at the head for enabling transverse oscillation of the needle bar relative to the direction of fabric feed in the household type sewing machine;

a transmitter configured to connect to a local device; and an image capture device configured to capture a video of a workpiece being sewn by the household type sewing machine, wherein the transmitter is configured to send the video captured by the image capture device to the local device wirelessly over at least one of an internet and a wireless local area network; and at least one host server, the at least one host server including:

instructions to perform a sewing pattern configured to be provided for download; and an application configured to be provided for downloaded, wherein, after being downloaded by a mobile device, the application is configured to:

allow the mobile device to connect to the household sewing machine over a wireless local area network;

provide the instructions to perform the sewing pattern to a display of the mobile device; and display the video captured by the image capture device on the mobile device.

14. The household type sewing machine system of claim 13, further comprising a purchasable physical sewing pattern including identifying information, wherein the application is configured to receive the identifying information and wherein the identifying information received by the application provides the mobile device with access to the instructions relating to the sewing pattern.

15. The household type sewing machine system of claim 13, wherein the application is configured to facilitate uploading, by the mobile device, the video onto a social media web interface.

16. The household type sewing machine system of claim 13, wherein the application is configured to provide machine instructions to the household type sewing machine, wherein the household type sewing machine is configured to receive the machine instructions and perform a function specified in the machine instructions.

* * * * *